United States Patent [19]

Deweese

[11] 4,363,147

[45] Dec. 14, 1982

[54] SURVIVAL TOOL

[76] Inventor: Melvin T. Deweese, P.O. Box 157, Warner Springs, Calif. 92086

[21] Appl. No.: 186,679

[22] Filed: Sep. 12, 1980

[51] Int. Cl.[3] ..... B25F 1/00

[52] U.S. Cl. ..... 7/158

[58] Field of Search ..... 7/106, 150, 158, 163, 7/167, 169

[56] References Cited

U.S. PATENT DOCUMENTS

| | | | |
|---|---|---|---|
| 3,119,424 | 1/1964 | Henry | 7/167 X |
| 3,187,354 | 6/1965 | Frisbie | 7/158 |
| 3,748,742 | 7/1973 | Bigler et al. | 7/158 X |
| 3,842,458 | 10/1974 | Baur | 7/158 X |
| 4,103,378 | 8/1978 | Granados | 7/167 X |

*Primary Examiner*—James G. Smith

*Attorney, Agent, or Firm*—Charmasson, Branscomb & Holz

[57] ABSTRACT

A survival tool has a cylindrical container portion for carrying small items helpful to survival, and a flattened plane-defining body portion with a large central void creating a hand grip, the edges of the body portion defining a straight axe edge, a game skinning notch, and a saw blade, the axe blade and container being oppositely positioned to make the tool useful as an axe by insertion of a stick into the container which acts as a socket to receive same.

6 Claims, 7 Drawing Figures

SURVIVAL TOOL

BACKGROUND

Many survival items and kits have been developed over the years, with the principal consideration being the incorporation of the maximum number of features and functions in the smallest, lightest device inasmuch as one in a survival situation ordinarily will not have in his possession vast amounts of sophisticated gear. Except for training, one put in a survival situation does not ordinarily have advanced notice of the certainity of being in such a predicament, and therefore any such tool or kit useful in surviving in the wilderness must be small and light weight enough to make the carrying of same at all times when in a high risk situation a practical proposition.

Additionally, inasmuch as survival in different areas of the world and under different climatic and geographical circumstances indicates the incorporation of a different variety of survival implements, there is a need for a basic tool or kit designed to be versatile enough to include a series of alternatively selectable small items which may be assimilated to create a kit designed specifically for a particular area of use.

SUMMARY

The present invention conforms to the above-stated criteria for good survival tool design and incorporates as one of its basic elements a socket which doubles as a mounting for an impromptu axe handle made from a handy stick or, when not used as an axe, end caps are used to create from the socket a container suitable for transporting an aggregation of small items suitable for survival in the area in question.

Integral with this socket/compartment is a flat, open body portion defining hand grip convolutions adjacent the compartment and an axe blade on the side thereof opposite the compartment so that the device is easily converted into an axe by the insertion of an axe handle as stated above and lashing the stick to the tool through holes provided for that purpose. Additionally, one side edge of the body portion defines saw teeth so related to the hand grip as to be easily used to saw native timbers, and one of the more important features is a notch blade useful in slitting the hides of animals for the creation of clothing and shelter.

Other features of the device include file-type striations on one side of the body portion for use in sharpening knives and other sharp instruments, a hammer head, a ruled edge to permit measuring snare lines and the like, a magnetic signaling mirror which magnetically adheres to the hardened steel portion of the tool body, and the above-mentioned end caps which enclose the axe handle socket to define a compartment, each have a serrated exterior and cavitated interior useful in defining pivotal sockets for the upper end of a stick used in the rotating-stick fire starting method.

DETAILED DESCRIPTION OF THE PREFERRED EMBODIMENT

Figure 2:
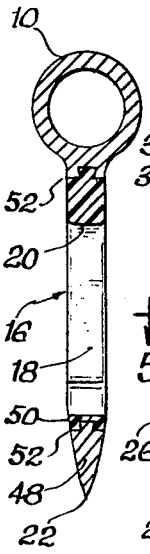
FIG. 2 is a section taken along line 2—2 of FIG. 1.

The tool is made of stainless steel or other hard, corrosion resistant material and has an elongated externally burred cylindrical socket-defining member 10 with threaded end caps 12 which may incorporate O-rings 14 or washers to insure the compartment is maintaind water tight inasmuch as the possessor of the tool might be swimming with it. When the caps are in place and the compartment is thus made water tight, it can contain quite a variety of extremely helpful items even though it is relatively small. These items might include fishing line, fishing hooks, a small compass and/or knife, signaling material, matches, a small file, snare wire, flints, a candle, or any of a variety of other items useful in particular circumstances for survival.

Adjacent the socket or compartment 10 is a flattened, plane-defining body portion 16 with a central void 18 defining along the socket side handgrip convolutions 20. The far edge of the body portion is curved into an axe blade 22 which terminates at its lower edge in a sharpened notch 24 quite useful in slitting animal skins. Continuing around the perimeter of the body portion, a saw blade is defined in the bottom at 26.

Striations may be incorporated as at 30 in a suitable position on the body, and a pair of holes defined at 32 in the body portion may be threaded with nylon taken from within the compartment, or by native materials, and used as tie strings to lash a stick shoved through the socket 10 onto the tool as an axe handle.

Figure 6:
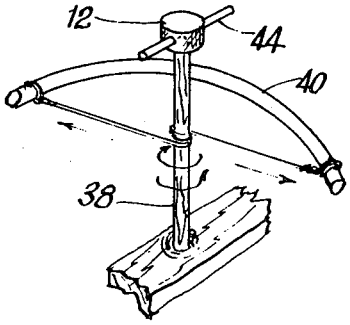
FIG. 6 is an illustration of the end cap being used as the top pivot of a fire starting stick.

Additionally, the two end caps 12 are externally burred at 34 and cavitated internally as at 36 so that they can be put in the hand and used as the upper bearing for a stick 38 rotated by a bow 40 for use in the old "rubbing two sticks together" method of starting a fire in the wild and bore 42 may be made through one end cap so that a transverse stick 44 may be used to help grip the end cap and prevent its rotation, as shown in FIG. 6.

Figure 1:
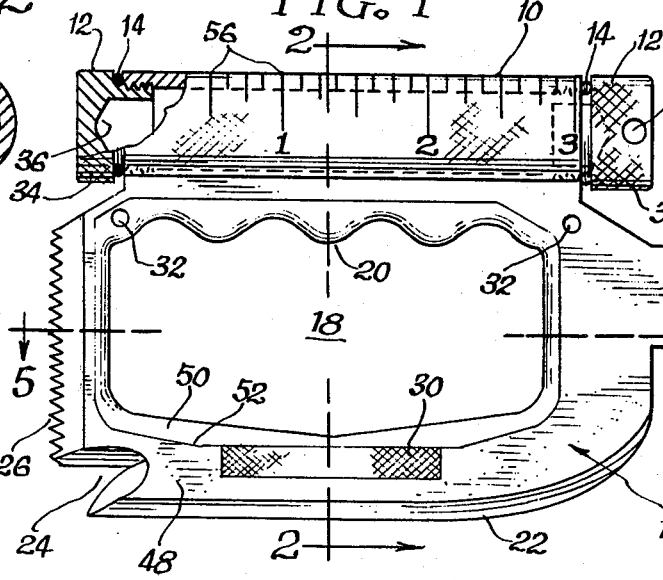
FIG. 1 is a side elevation view of the device.
Figure 3:
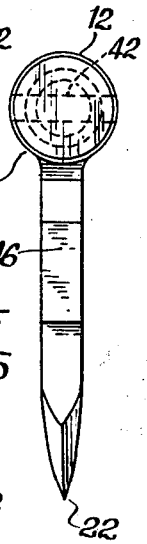
FIG. 3 is an end elevation from the right end of FIG. 1 with portions of the interior of the socket shown in dotted line.

The top of the body may be projected slightly to define a general utility hammer head 46, and in order to lighten the weight of the device slightly while preserving the strength necessary for the saw, axe and hammerhead, the unit may be made of two different metals, or a metal and a plastic as shown in FIGS. 1through 3 wherein the external portions 48 of the body 16 are made of hardened steel or the like and the interior 50 is plastic molded to the outer portion at interface 52.

Figure 7:
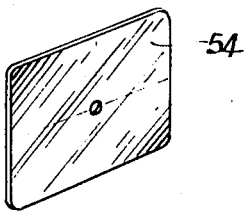
FIG. 7 is a perspective view of a signal mirror included as part of the tool.

A signal mirror shown at 54 in FIG. 7 is preferably included in the kit and is of sufficiently broad dimension to overlay the hardened steel perimeter 48 of a magnetic material.

Figure 4:
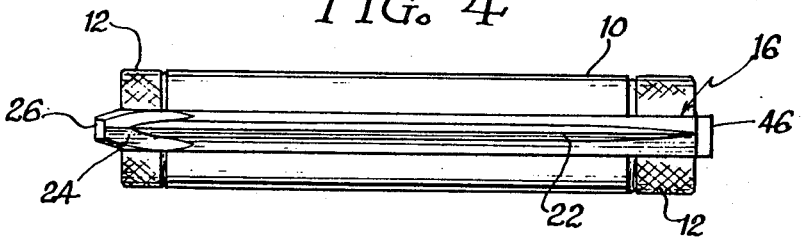
FIG. 4 is an elevation view looking from the bottom of the tool in FIG. 1.
Figure 5:
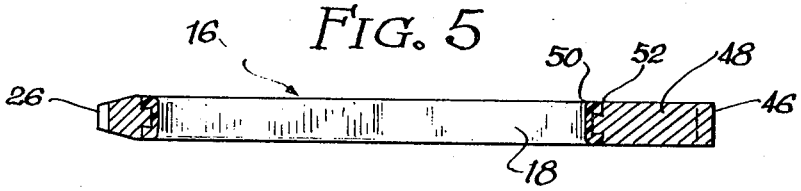
FIG. 5 is a section taken along line 5—5 of FIG. 1.

Also, in conjunction with the snare wires and instructions which may be included in the container 10, the tool is ideally provided with an edge ruled in inches or centimeters to enable the user to implement the instructions accurately by executing snare construction and the like with correct line lengths. A suitable inch ruler is indicated at 56 in FIG. 4.

Modifications of the invention within the scope and spirit of the instant description and appended claims are of course within the intended ambit of the invention provided the universal versatility and compactness of design of the tool be retained.

I claim:

1. A survival tool comprising:

(a) a body portion defining a central void;

(b) a cutting edge defined by one edge of said body portion;

(c) a hollow socket member integral with the edge of said body portion opposite said cutting edge to serve as an axe handle mount and convert said tool to a serviceable axe and serviceable also as a handgrip usable by extending the fingers through said void and gripping said socket member with the hand;

(d) cap means for enclosing said socket to define a supply container when said kit is not in service as an axe; and (e) said cap means including at least one cap with a smooth cavitated interior whereby said cap is useful as the upper pivot bearing of a rotated fire starter stick.

2. Structure according to claim 1 wherein said cap is transversely bored to accept a hand-held stabilizing stick.

3. A survival tool comprising:

(a) a body portion defining a central void;

(b) a cutting edge defined by one edge of said body portion;

(c) a hollow socket member integral with the edge of said body portion opposite said cutting edge to serve as an axe handle mount and convert said tool to a serviceable axe and serviceable also as a handgrip usable by extending the fingers through said void and gripping said socket member with the hand;

(d) cap means for enclosing said socket to define a supply container when said kit is not in service as an axe; and (e) an edge of said body portion between said socket member and said cutting edge defining a saw blade.

4. Structure according to claim 3 wherein the edge of said body portion opposite said saw blade defines a hammer head.

5. A survival tool comprising:

(a) a body portion defining a central void;

(b) a cutting edge defined by one edge of said body portion;

(c) a hollow socket member integral with the edge of said body portion opposite said cutting edge to serve as an axe handle mount and convert said tool to a serviceable axe and serviceable also as a handgrip usable by extending the fingers through said void and gripping said socket member with the hand;

(d) cap means for enclosing said socket to define a supply container when said kit is not in service as an axe; and (e) a pair of holes defined in said body adjacent the ends of said socket for entraining a lash means therethrough for securing a stick to said tool.

6. A survival tool comprising:

(a) a handgrip;

(b) a generally planar body portion extending from said handgrip;

(c) at least a portion of the edges of said body defining a blade; and, (d) at least substantial portions of the perimeters of said body portions are fabricated of ferromagnetic material and including a magnetic mirror shaped substantially in conformity with the peripheral planform of said body portions and of sufficient dimensions to substantially overlay said ferromagnetic material.

* * * * *